US005431224A

United States Patent [19]

Laali

[11] Patent Number: 5,431,224

[45] Date of Patent: Jul. 11, 1995

[54] METHOD OF THERMAL STIMULATION FOR RECOVERY OF HYDROCARBONS

[75] Inventor: Hooman Laali, Dallas, Tex.

[73] Assignee: Mobil Oil Corporation, Fairfax, Va.

[21] Appl. No.: 229,988

[22] Filed: Apr. 19, 1994

[51] Int. Cl.[6] ..... E21B 43/243

[52] U.S. Cl. ..... 166/256; 166/302

[58] Field of Search ..... 166/256, 257, 258, 259, 166/261, 251, 302, 303

[56] References Cited

U.S. PATENT DOCUMENTS 2,771,140 11/1956 Barclay et al. ..... 166/60
3,603,396 9/1971 Braun ..... 166/261
3,638,727 2/1972 Allen et al. ..... 166/261 X
4,474,237 10/1984 Shu ..... 166/261
4,617,997 10/1986 Jennings, Jr. ..... 166/299
4,648,456 3/1987 Lamb et al. ..... 166/259 X
5,052,490 10/1991 Reed ..... 166/303

*Primary Examiner*—Stephen J. Novosad
*Attorney, Agent, or Firm*—Alexander J. McKillop; George W. Hager, Jr.

[57] ABSTRACT

A method for improving hydrocarbon flow from a consolidated, tight reservoir rock having authigenic clay cementation includes thermally heating the reservoir rock in-situ surrounding a production well to change the mode of occurrence of clay cements within the rock so as to enhance reservoir permeability and carrying out rapid flowback into the production well.

3 Claims, 1 Drawing Sheet

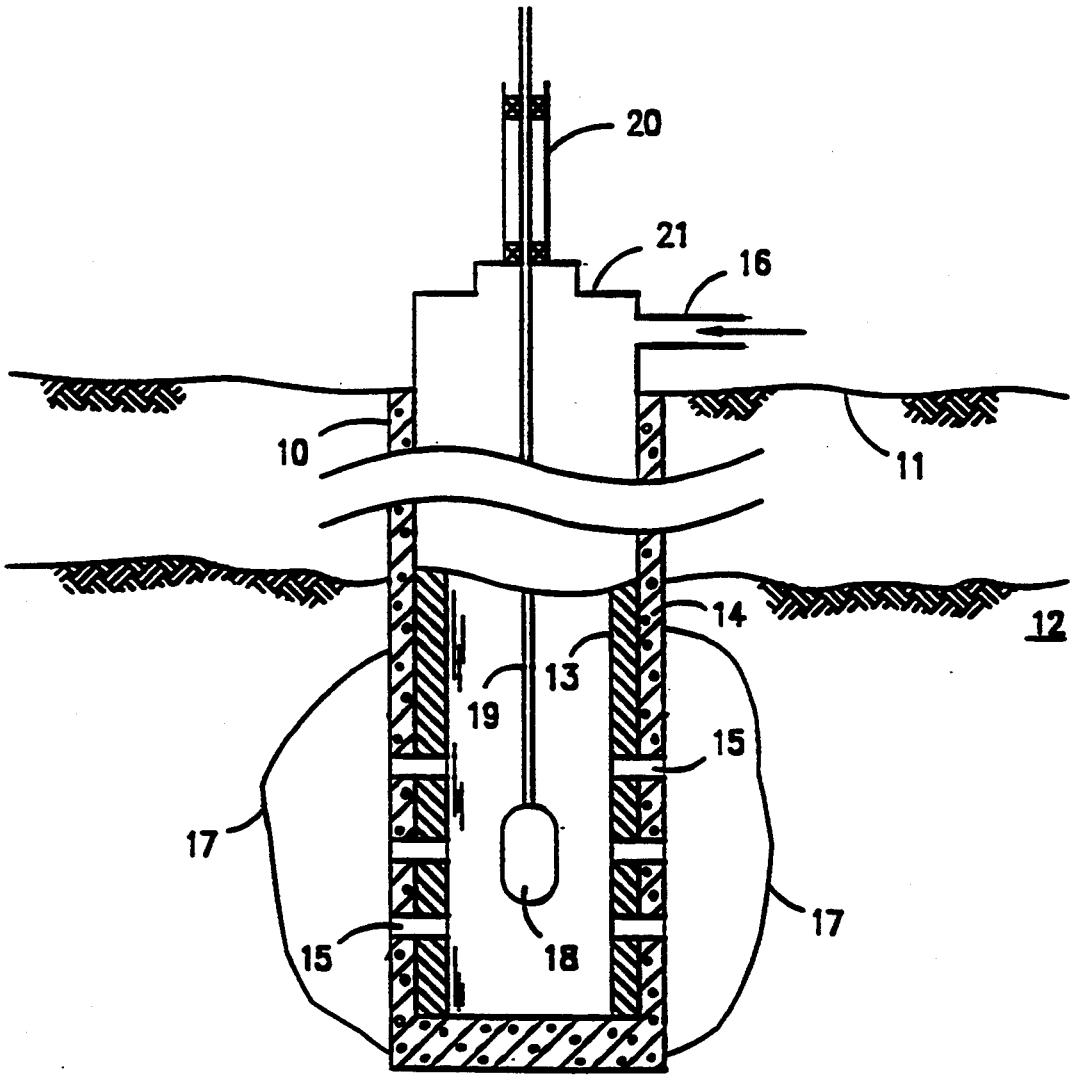
20
21
16
10
11
12
14
13
19
15
17
17
15
18

METHOD OF THERMAL STIMULATION FOR RECOVERY OF HYDROCARBONS

BACKGROUND OF THE INVENTION

This invention relates to thermal recovery of hydrocarbons from a subsurface formation surrounding a wellbore penetrating a consolidated hydrocarbon-bearing reservoir.

Originally tight reservoir rocks in consolidated formations which suffer from authigenic clay cementation exhibit low permeability that impedes the flow of oil and gas into a wellbore penetrating such reservoir rocks. Conventional matrix stimulation techniques have not been effective in increasing permeability.

It is therefore an object of the present invention to provide for a new thermal recovery technique that improves the inherently low permeability of such light reservoir rocks by effecting a change in the mode of occurrence of authigenic clays within the rock thereby stimulating oil and gas production from the reservoir.

SUMMARY OF THE INVENTION

In accordance with the present invention there is provided a method for improving hydrocarbon flow from low permeability tight reservoir rock of consolidated formations having authigenic clay cementation surrounding a well penetrating a hydrocarbon-bearing reservoir. Combustion is initiated within the tight reservoir rock to change the mode of occurrence of clay cements within the rock, thereby enhancing reservoir permeability. Rapid flowback into the well is thereafter immediately carried out.

Further enhancement of hydrocarbon production may be effected by acidizing or hydraulically fracturing the reservoir.

BRIEF DESCRIPTION OF THE DRAWING

The sole FIGURE of drawings illustrates a subsurface hydrocarbon-bearing reservoir being treated in accordance with the thermal recovery treatment of the present invention.

DESCRIPTION OF THE PREFERRED EMBODIMENT

For a description of the method of the present invention for thermal recovery of hydrocarbons from a consolidated, tight reservoir rock having authigenic clay cementation, reference is made to the drawing where there is shown a well 10 which extends from the surface of the earth 11 and penetrates a subterranean formation 12 which may contain, for example, a hydrocarbon-bearing reservoir. The well 10 includes a casing which is cemented into place by a cement sheath 14. Perforations 15 are provided through the casing 13 and cement sheath 14 to open communication between the interior of the well 10 and the subterranean formation 12. An open-hole well without cemented casing may also be treated.

A combustible fluid such as hydrocarbon, linseed oil, or methane gas, for example, is pumped under hydraulic pressure into the well 10 by way of port 16 and out through perforations 15 into the formation 12 immediately surrounding the well. Combustion is then initiated by injection of air or oxygen within the formation 12 near the well 10 to effect a burning of the formation adjacent the well 10. This burning is particularly effective in the low permeability, tight reservoir rock of formation 12 having authigenic clay cementation to change the mode of occurrence, or structure, of the clay cements and thereby enhance formation permeability. This permeability enhancement is attributed to changes in the occurrence of the authigenic clay cements in the pores from pore-coating and/or pore-bridging to flattened/matted down mode.

After thermal stimulation has been effected, the air-/oxygen flow is stopped and the well is made to undergo rapid flowback into the well be and to a separator (not shown) at the surface of the earth lb. The separator surface pressure is set relatively low at about 150 psi. This largely allows for an unimpeded flow to the surface. If the well does not allow such flow, the hydrostatic pressure may be reduced by injecting nitrogen or other safe gas to artificially lift the oil or gas column and thereby encourage flow. This thermal stimulation may be followed by an acidizing treatment or a hydraulic fracturing treatment in order to maximize hydrocarbon production from the reservoir of formation 12.

The combustion step may be initiated by any of several well known conventional methods. As shown in the drawing, a combustion igniter 18 is suspended within the well 10 from the surface 11 by means of the conduit 19 set through a high pressure lubricator 20 at the wellhead 21. Any of several well known types of downhole igniters may be utilized, for example, U.S. Pat. No. 2,771,140 to Barclay et al. discloses an electrical igniter, U.S. Pat. No. 4,474,237 to W. R. Shu discloses a gas-fired burner and U.S. Pat. No. 4,617,997 to A. R. Jennings, Jr. discloses a canister having an ignitable propellant, the teachings of each of which are incorporated herein by reference. There is no need to melt or fuse the reservoir rock although additional benefits of fines stabilization may be realized. The ignition temperature range depends upon, among other things, the reactant used and the nature of the original rock fluids. Initial ignition temperature may reach as high as 1,000° F. The intended change of mode of occurrence and morphology of clays within the pore spaces requires "in-situ drying" rather than prolonged heat and high temperature which may be used to change fundamental structure of the clay. However, very high temperature or prolonged application does not prevent the desired result. Temperature, therefore, is not a controlling factor. It is suggested that a temperature higher than bottomhole temperature be attained for the sake of practicality as well as economic viability.

Combustion is carried out only long enough to ensure ignition of all the quick-igniting reactant placed in the designated treatment area in the immediate area of the wellbore. Time of treatment depends on the designed volume, but usually will take hours and days rather than months. In this regard, this application differs from other thermal combustion floods which attempt to drive fluids away to a distant producer and therefore, take months or years to complete.

Treatment volume (includes depth into the formation) is designed for optimum results for each individual case. Steady state radial flow equations indicate that treatment nearest the wellbore is most important. It is envisioned that most applications will treat to a horizontal depth from the wellbore of 20 to 30 feet, but need not be restricted. This is advantageous over the existing conventional stimulation such as matrix acidizing where depth of treatment is restricted due to intense reaction which causes the acid to be spent in the very immediate wellbore area. The depth of treatment is controlled by isolation of the zone of interest and the injection of a known volume of the reactant agent to saturate and reach the desired depth of treatment. Ignition will be stopped by cutting off the flow of air or oxygen or other fluids used to attain combustion when all the reactant has ignited and is spent. The depth of treatment will always be approximate due to the natural heterogeneity of the reservoir rock properties. Treating the exact depth is not a detrimental factor since the bulk of the treatment will result in significant improvement.

As can be seen from the foregoing, the present invention is a new stimulation procedure that utilizes thermal energy to change the mode of occurrence of clay cements in tight reservoir rocks. This causes a much more effective matrix stimulation and negative skin characteristics. Thermal recovery is applied to all hydrocarbon reservoirs regardless of whether they are heavy oil, light oil or gas bearing. The present invention differs from conventional thermal recovery in that it is limited to the immediate wellbore area, no prolonged injection of air or oxygen is warranted, and it is safer and less corrosive than conventional fireflooding.

While the foregoing has described and illustrated a preferred method for carrying out the thermal recovery technique of the present invention, those skilled in the art will recognize that many modifications and variations besides those specifically set forth may be made in the techniques described herein without departing from the spirit and scope of the invention as set forth in the appended claims.

I claim:

1. A method for improving hydrocarbon flow from low permeability, tight reservoir rock having authigenic clay cementation surrounding a well penetrating a hydrocarbon-bearing reservoir, comprising the steps of:

a) injecting a known volume of a combustible fluid through said well into said low permeability, tight reservoir rock surrounding said well, said known volume of combustible fluid being sufficient, upon in-situ combustion, to cause a change in the structure of the clay cement within the pores of said reservoir rock without changing the fundamental structure of said reservoir rock, b) initiating combustion within said tight reservoir rock by means of a downhole igniter and c) terminating combustion when all of said known volume of combustible fluid injected into said reservoir rock has been ignited and spent.

2. The method of claim 1 wherein temperature of combustion is higher than the bottom hole temperature within said well.

3. The method of claim 2 wherein said temperature of combustion does not exceed 1000° F.

* * * * *